US007371710B2

(12) United States Patent
Morita

(10) Patent No.: US 7,371,710 B2
(45) Date of Patent: May 13, 2008

(54) LUBRICATING OIL COMPOSITION

(75) Inventor: Eitaro Morita, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 532 days.

(21) Appl. No.: 10/797,386

(22) Filed: Mar. 10, 2004

(65) Prior Publication Data

US 2004/0176258 A1 Sep. 9, 2004

Related U.S. Application Data

(63) Continuation of application No. PCT/JP02/09122, filed on Sep. 6, 2002.

(30) Foreign Application Priority Data

Sep. 17, 2001 (JP) ..... 2001-282318

(51) Int. Cl.
*C10M 125/26* (2006.01)
*C10M 141/12* (2006.01)

(52) U.S. Cl. ..... 508/156; 508/158; 508/192; 508/390; 508/391; 508/460; 508/518

(58) Field of Classification Search ..... 508/156–160, 508/192
See application file for complete search history.

(56) References Cited

U.S. PATENT DOCUMENTS

| | | | | |
|---|---|---|---|---|
| 3,853,772 | A * | 12/1974 | Adams | 508/156 |
| 4,089,790 | A * | 5/1978 | Adams | 508/156 |
| 5,739,088 | A * | 4/1998 | Inoue et al. | 508/156 |
| 6,534,450 | B1 * | 3/2003 | Harrison et al. | 508/158 |
| 6,617,286 | B2 * | 9/2003 | Sato et al. | 508/192 |
| 6,632,781 | B2 * | 10/2003 | Harrison et al. | 508/158 |
| 6,737,387 | B2 * | 5/2004 | Harrison et al. | 508/158 |
| 6,841,521 | B2 * | 1/2005 | Boffa et al. | 508/156 |
| 7,026,273 | B2 * | 4/2006 | Robson et al. | 508/156 |
| 2001/0034305 | A1 | 10/2001 | Komatsubara | |

FOREIGN PATENT DOCUMENTS

| | | | |
|---|---|---|---|
| EP | 0 695 798 | A2 | 2/1996 |
| JP | 2000-063878 | A | 2/2000 |
| JP | 2002-003875 | A | 1/2002 |
| JP | 2002-129182 | A | 5/2002 |
| WO | WO 96/37585 | A1 | 11/1996 |

* cited by examiner

*Primary Examiner*—Ellen M. McAvoy
(74) *Attorney, Agent, or Firm*—Panitch Schwarze Belisario & Nadel LLP

(57) ABSTRACT

Lubricating oil compositions particularly suitable for automatic transmissions comprising a lubricating base oil, (A) a boron-containing ashless dispersant in an amount of 0.02 to 0.1 percent by mass in terms of boron, based on the total mass of the composition, (B) an alkaline earth metal-based detergent with a base number of 0 to 500 mgKOH/g in an amount of 0.01 percent by mass or more in terms of alkaline earth metal, based on the total mass of the composition, and (C) an alkali metal borate or a hydrate thereof and having excellent anti-wear properties and improved fatigue life by inhibiting pitching.

6 Claims, No Drawings

LUBRICATING OIL COMPOSITION

CROSS-REFERENCE TO RELATED APPLICATION

This application is a continuation of International Application No. PCT/JP02/09122, filed Sep. 6, 2002, the disclosure of which is incorporated herein by reference.

BACKGROUND OF THE INVENTION

This invention relates to lubricating oil compositions and more particularly to those which have excellent anti-wear properties and a long fatigue life, suitable for transmissions for automobiles.

An automatic transmission for automobiles comprises a torque converter, a planetary gear unit, bearings, a wet clutch, and a hydraulic control unit controlling these components. However, in recent years, automatic transmissions have been susceptible to more sever load than ever due to the progresses of the development of high-powered engines and of the downsizing of automatic transmissions. Lubricating oils to be filled into such transmissions, i.e., transmission oils are required to have excellent extreme pressure properties and anti-wear properties while maintaining a high lubricity and a long fatigue life which is an ability to prevent pitching or flaking (defects at the lubricated surface because of being damaged) in bearings and gears for a long life.

In order to meet such requirements, it is known that for example lubricating oils such as automotive transmission oils are blended with sulfur- or phosphorus-based additives having excellent extreme pressure properties and anti-wear properties. While sulfur-based additives are excellent in extreme pressure properties, they can not avoid wears caused by corrosion and abrasion due to their strong activity to metal surfaces, leading to a problem when they are used alone. On the other hand, phosphorus-based additives are less in wear caused by corrosion and abrasion due to their weaker activity to metal surfaces, than the sulfur-based additives but often have problems due to the lack of extreme pressure properties to avoid pitching or flaking when they are used alone in automatic transmissions where extreme pressure properties are required to be exhibited under severe conditions.

BRIEF SUMMARY OF THE INVENTION

In view of the foregoing circumstances, the object of the present invention is to provide a lubricating oil composition, particularly suitable as an automotive transmission oil, which is excellent in anti-wear properties and capable of inhibiting pitching, resulting in an improved fatigue life.

After an extensive research and study, it was found that the use of the combination of specific boron-containing ashless dispersants, metal-based detergents, and alkali metal borates enables to produce a lubricating oil composition which is improved in anti-wear properties and capable of inhibiting pitching, resulting in an improved fatigue life.

That is, according to the present invention, there is provided a lubricating oil composition which comprises a lubricating base oil, (A) a boron-containing ashless dispersant in an amount of 0.02 to 0.1 percent by mass in terms of boron, based on the total mass of the composition, (B) an alkaline earth metal-based detergent with a base number of 0 to 500 mgKOH/g in an amount of 0.01 percent by mass or more in term of alkaline earth metal, based on the total mass of the composition, and (C) an alkali metal borate or a hydrate thereof.

In the present invention, Component (C) is preferably a potassium borate hydrate.

Component (C) is preferably contained in an amount of 0.002 to 0.1 percent by mass in terms of boron based on the total mass of the composition.

Component (A) is preferably a succinimide modified with a boron compound.

Component (B) is preferably an alkaline earth metal sulfonate or an alkaline earth metal salicylate.

Component (B) is preferably an alkaline earth calcium.

The lubricating oil composition is preferably used in an automatic transmission equipped with a wet clutch.

DETAILED DESCRIPTION OF THE INVENTION

The present invention will be described below in more detail.

(1) Lubricating Base Oil

Lubricating base oils used in the present invention may be any mineral base oils and/or synthetic base oils which have conventionally been used as base oils for lubricating oils.

Examples of such mineral base oil include paraffinic or naphthenic oils which can be obtained by subjecting a lubricating oil fraction produced by atmospheric- or vacuum-distilling a crude oil, to any one or more refining processes selected from solvent deasphalting, solvent extraction, hydrocracking, solvent dewaxing, catalytic dewaxing, hydrorefining, washing with sulfuric acid, and clay treatment; and n-paraffines.

No particular limitation is imposed on synthetic oils. However, examples of synthetic base oils include poly-α-olefins such as 1-octene oligomer, 1-decene oligomer, and ethylene-propylene oligomer, and hydrides thereof; isobutene oligomer and hydrides thereof; isoparaffines; alkylbenzenes; alkylnaphthalenes; diesters such as ditridecyl glutarate, di-2-ethylhexyl adipate, diisodecyl adipate, ditridecyl adipate, and di-2-ethylhexyl cebacate; polyol esters such as trimethylolpropane caprylate, trimethylolpropane pelargonate, pentaerythritol-2-ethyl hexanoate, and pentaerythritol pelargonate; polyoxyalkylene glycols; dialkyldiphenyl ethers; and polyphenyl ethers.

No particular limitation is imposed on the kinematic viscosity of the lubricating base oil. However, the kinematic viscosity at 100° C. of the lubricating base oil is preferably from 1 to 20 $mm^2/s$, and more preferably from 2 to 10 $mm^2/s$.

(2) (A) Boron-containing Ashless Dispersant

Component (A) of the lubricating oil composition of the present invention is a boron-containing ashless dispersant.

Component (A) importantly contains boron. In the case where a boron-free ashless dispersant is used as Component (A), it can not achieve the purposes of the present invention because it not only fails to inhibit fatigue caused by pitching or flaking but also becomes ineffective in anti-wear properties and oxidation stability even though it is used in combination with Components (B) and (C) described below.

Although the boron content in Component (A) is arbitrarily selected, the lower limit is preferably 0.2 percent by mass, more preferably 0.4 percent by mass with the objective of excellent fatigue life and anti-wear properties while the upper limit is 4 percent by mass, more preferably 2.5 percent by mass.

Specific examples of Component (A) include modified products with a born compound, such as nitrogen-containing compounds having at least one alkyl or alkenyl group having 40 to 400 carbon atoms per molecule and derivatives thereof. Any one or more kinds selected from these compounds may be blended.

The alkyl or alkenyl group may be straight-chain or branched but is preferably a branched alkyl or alkenyl group derived from an oligomer of an olefin such as propylene, 1-butene, and isobutylene or a cooligomer of ethylene and propylene.

Although the carbon number of the alkyl or alkenyl group is optional, it is preferably 40 to 400, more preferably 60 to 350 carbon atoms. An alkyl or alkenyl group having less than 40 carbon atoms would deteriorate the solubility of the compound in a base oil, while an alkyl or alkenyl group having more than 400 carbon atoms would deteriorate the low-temperature fluidity of the resulting lubricating oil composition.

Specific examples of the nitrogen-containing compound are any one or more kinds of compounds selected from:

(A-1) succinimides having at least one alkyl or alkenyl group having 40 to 400 carbon atoms per molecule or derivatives thereof;

(A-2) benzylamines having at least one alkyl or alkenyl group having 40 to 400 carbon atoms per molecule or derivatives thereof; and (A-3) polyamines having at least one alkyl or alkenyl group having 40 to 400 carbon atoms per molecule or derivatives thereof.

Specific examples of (A-1) succinimides are those represented by the formulas:

(1)

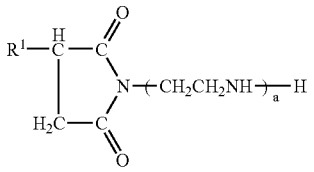

(2)

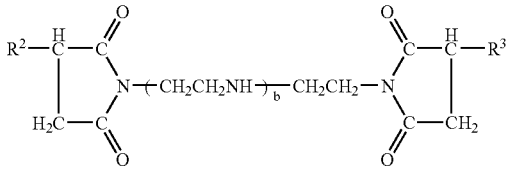

In formula (1), $R^1$ is an alkyl or alkenyl group having 40 to 400, preferably 60 to 350 carbon atoms, and a is an integer from 1 to 5, preferably 2 to 4.

In formula (2), $R^2$ and $R^3$ are each independently an alkyl or alkenyl group having 40 to 400, preferably 60 to 350 carbon atoms, and b is an integer from 0 to 4, preferably 1 to 3.

The succinimides are classified into mono-type succinimides wherein a succinic anhydride is added to one end of a polyamine as represented by formula (1) and bis-type succinimides wherein a succinic anhydride is added to both ends of a polyamine as represented by formula (2). In the present invention, both types of the succinimides and mixtures thereof can be used as Component (A).

Specific examples of (A-2) benzylamines are compounds represented by the formula (3)

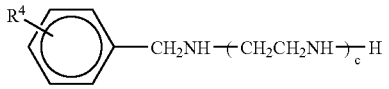

In formula (3), $R^4$ is an alkyl or alkenyl group having 40 to 400, preferably 60 to 350 carbon atoms, and c is an integer from 1 to 5, preferably 2 to 4.

No particular limitation is imposed on the method of producing the benzylamines. However, for example, one of the benzylamines may be produced by reacting a polyolefin such as propylene oligomer, polybutene, or ethylene-α-olefin copolymer with phenol so as to obtain an alkylphenol, followed by a Mannich reaction thereof with formaldehyde and a polyamine such as diethylenetriamine, triethylenetetramine, tetraethylenepentamine, or pentaethylenehexamine.

Specific examples of (A-3) polyamines are compounds represented by the formula (4)

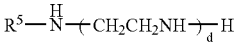

In formula (4), $R^5$ is an alkyl or alkenyl group having 40 to 400, preferably 60 to 350 carbon atoms, and d is an integer from 1 to 5, preferably 2 to 4.

No particular limitation is imposed on the method of producing the polyamines. For example, one of the polyamines may be produced by subjecting a polyolefin such as propylene oligomer, polybutene, or ethylene-α-olefin copolymer to chloridization, followed by a reaction with ammonia or a polyamine such as ethylenediamine, diethylenetriamine, triethylenetetramine, tetraethylenepentamine, or pentaethylenehexamine.

Specific examples of the derivatives of the nitrogen-containing compound are carboxylic acid-modified compounds obtained by bringing any one of the aforesaid nitrogen-containing compounds into a reaction with a monocarboxylic acid (fatty acid) having 2 to 30 carbon atoms or a polycarboxylic acid having 2 to 30 carbon atoms, such as oxalic acid, phthalic acid, trimellitic acid, or pyromellitic acid so as to neutralize or amidize the whole or part of the remaining amino and/or imino groups; sulfur-modified compounds obtained by bringing any one of the aforesaid nitrogen-containing compounds into a reaction with a sulfuric compound; and mixtures thereof.

Component (A) used in the present invention is a compound obtained by modifying any one of the aforesaid nitrogen-containing compounds or a derivative thereof with a boron compound.

No particular limitation is imposed on the method of modifying the nitrogen compounds or derivatives thereof with a boron compound. Therefore, any suitable method may be employed. For example, any one of the aforesaid nitrogen compounds or derivatives thereof is reacted with a boron compound such as boric acid, a borate, or a boric acid ester so as to neutralize or amidize the whole or part of the amino and/or imino groups remaining in the nitrogen-containing compound or derivative thereof.

Specific examples of the boron compounds used herein are orthoboric acid, methaboric acid, and tetraboric acid.

Examples of borates are alkali metal salts, alkaline earth metal salts, or ammonium salts of boric acid. More specific examples are lithium borate such as lithium methaborate, lithium tetraborate, lithium pentaborate, and lithium perborate, sodium borate such as sodium methaborate, sodium diborate, sodium tetraborate, sodium pentaborate, sodium hexaborate, and sodium octaborate, potassium borate such as potassium methaborate, potassium tetraborate, potassium pentaborate, potassium hexaborate, and potassium octaborate, calcium borate such as calcium methaborate, calcium diborate, tricalcium tetraborate, pentacalcium tetraborate, and calcium hexaborate, magnesium borate such as magnesium methaborate, magnesium diborate, trimagnesium tetraborate, pentamagnesium tetraborate, and magnesium hexaborate, and ammonium borate such as ammonium methaborate, ammonium tetraborate, ammonium pentaborate, and ammonium octaborate. Examples of the boric acid esters are esters of boric acid and an alkyl alcohol having 1 to 6 carbon atoms and more specifically monomethyl borate, dimethyl borate, trimethyl borate, monoethyl borate, diethyl borate, triethyl borate, monopropyl borate, dipropyl borate, tripropyl borate, monobutyl borate, dibutyl borate, and tributyl borate.

Preferred for Component (A) are those obtained by modifying (A-1) succinimides having at least one alkyl or alkenyl group having 40 to 400 carbon atoms per molecule or derivatives thereof used as the aforesaid nitrogen-containing compounds with the aforesaid boron compounds; and mixtures thereof with the objective of improved fatigue life and anti-wear properties.

The lower limit content of Component (A) in the lubricating oil composition of the present invention is 0.02 percent by mass, preferably 0.03 percent by mass in terms of boron, based on the total mass of the composition, while the upper limit is 0.1 percent by mass, preferably 0.08 percent by mass in terms of boron, based on the total mass of the composition. Component (A) of less than the lower limit would be ineffective in inhibiting pitching or flaking, while Component (A) of more than the upper limit would deteriorate the oxidation stability of the resulting lubricating oil composition.

(3) (B) Metal-based Detergent

Component (B) used in the present invention is an alkaline earth metal-based detergent.

Component (B) has a base number of 0 to 500 mgKOH/g, preferably 0 to 400 mgKOH/g. Component (B) having a base number in excess of 500 mgKOH/g is unstable in structure and deteriorates the storage stability of the resulting oil composition. The term "base number" used herein denotes a base number measured by the perchloric acid potentiometric titration method in accordance with section 7 of JIS K2501 (1992) "Petroleum products and lubricants-Determination of neutralization number".

In the present invention, the use of Component (B) makes it possible to not only improve the properties to inhibiting fatigue caused by pitching or flaking and the anti-wear properties but also optimize the friction properties of a wet clutch and thus suppress the decrease in strength thereof caused by repeatedly applied compression.

Specific examples of Component (B) are any one or more kinds of metal-based detergents selected from:

(B-1) alkaline earth metal sulfonates having a base number of 0 to 500 mgKOH/g;

(B-2) alkaline earth metal salicylates having a base number of 0 to 500 mgKOH/g; and (B-3) alkaline earth metal phenates having a base number of 0 to 500 mgKOH/g.

Specific examples of (B-1) alkaline earth metal sulfonates are alkaline earth metal salts, particularly preferably magnesium salts and/or calcium salts, of an alkyl aromatic sulfonic acid obtained by sulfonating an alkyl aromatic compound having a molecular weight of 100 to 1,500 and preferably 200 to 700. Specific examples of the alkyl aromatic sulfonic acids are petroleum sulfonic acids and synthetic sulfonic acids.

Petroleum sulfonic acids may be those obtained by sulfonating the alkyl aromatic compound contained in the lubricant fraction of a mineral oil or mahogany acid by-produced upon production of white oil. Synthetic sulfonic acids may be those obtained by sulfonating an alkyl benzene having a straight-chain or branched alkyl group, which may be by-produced from a plant for producing an alkyl benzene used as materials of detergents or obtained by alkylating a polyolefin to benzene or by sulfonating dinonylnaphthalene. No particular limitation is imposed on sulfonating agents used for sulfonating alkyl aromatic compounds. However, fuming sulfuric acids and sulfuric acid are generally used.

Examples of (B-2) alkaline earth metal salicylates are alkaline earth metal salts, preferably magnesium salts and/or calcium salts, of an alkyl salicylic acid having at least one straight-chain or branched alkyl group having 4 to 30, preferably 6 to 18 carbon atoms.

Specific examples of (B-3) alkaline earth metal phenates are alkaline earth metal salts, preferably magnesium salts and/or calcium salts, of alkylphenolsulfides obtained by reacting an alkylphenol having at least one straight-chain or branched alkyl group having 4 to 30, preferably 6 to 18 carbon atoms with sulfur or of a Mannich reaction product obtained by reacting such an alkylphenol with formaldehyde.

As long as Component (B), i.e., an alkaline earth metal sulfonate, an alkaline earth metal salicylate or an alkaline earth metal phenate each has a base number within a range of 0 to 500 mgKOH/g, it may be a neutral (normal) salt obtained by reacting an alkylaromatic sulfonic acid, an alkyl salicylic acid, an alkylphenol, an alkylphenolsulfide, or a Mannich reaction product of an alkylphenol directly with an alkaline earth metal base such as an oxide or hydroxide of an alkaline earth metal of magnesium and/or calcium or obtained by substituting an alkylaromatic sulfonic acid, an alkyl salicylic acid, an alkylphenol, an alkylphenolsulfide, or a Mannich reaction product of an alkylphenol which has once been converted to an alkali metal salt such as a sodium salt or a potassium salt, with an alkaline earth metal salt. Alternatively, Components (B) may be a basic salt obtained by heating a normal salt as described above with an excess amount of an alkaline earth metal salt or an alkaline earth metal base (a hydroxide or oxide of an alkaline earth metal) in the presence of water. Further alternatively, Component (B) may be an overbased salt obtained by reacting a normal salt as described above with a base of an alkaline earth metal in the presence of carbonic acid gas.

These reactions are usually conducted in a solvent including an aliphatic hydrocarbon solvent such as hexane, an aromatic hydrocarbon solvent such as xylene, or a light fraction lubricating base oil. Metal-based detergents are commercially available in the form of being diluted with a light fraction lubricating base oil. It is preferred to use a metal-based detergent whose metal content is within the range of 1.0 to 20 percent by mass, preferably 2.0 to 16 percent by mass.

The lower limit content of Component (B) is 0.01 percent by mass, preferably 0.05 percent by mass, more preferably 0.1 percent by mass, and particularly preferably 0.15 percent by mass in terms of an alkaline earth metal, based on the total mass of the composition. No particular limitation is imposed on the upper limit of Component (B). However, the upper limit is preferably 0.7 percent by mass or less, and particularly preferably 0.4 percent by mass or less, based on the total mass of the composition.

Component (B) of less than the lower limit would be ineffective in inhibiting fatigue caused by pitching or flaking even though combined with the above described Component (A) and Component (C) described below, while Component (B) in excess of 0.7 percent by mass would deteriorate the oxidation stability of the resulting composition.

(4) (C) Alkali Metal Borate and Hydrate Thereof

Component (C) used in the present invention is an alkali metal borate or a hydrate thereof.

Examples of Component (C) are lithium borate hydrate, sodium borate hydrate, potassium borate hydrate, rubidium borate hydrate, and cesium borate hydrate. Particularly preferred is potassium borate hydrate.

For example, these alkali metal borates can be obtained in the form of a fine particle-like dispersant of potassium borate hydrate or sodium borate hydrate obtained by dissolving potassium hydroxide or sodium hydroxide and boric acid in water such that the atomic ratio of boron and an alkali metal (potassium, sodium, or the like) is within the range of 2.0 to 4.5, adding the resulting solution to an oil solution containing a neutral alkaline earth metal sulfonate or a succinimide-based ashless dispersant, followed by stirring vigorously so as to obtain an oil in water emulsion, and dehydrating the emulsion.

The content of Component (C) may be arbitrarily selected. However, the lower limit content is 0.002 percent by mass, preferably 0.005 percent by mass in terms of boron, based on the total mass of the composition. The upper limit is 0.1 percent by mass, preferably 0.06 percent by mass in terms of boron, based on the total mass of the composition. Component (C) of less than 0.002 percent by mass in terms of boron would result in a lubricating oil composition which is ineffective in inhibiting fatigue caused by pitching or flaking, while Component (C) in excess of 0.1 percent by mass in terms of boron would deteriorate the storage stability of the resulting lubricating oil composition.

When Component (C) is obtained in the form of a dispersant in an alkaline earth metal sulfonate, the resulting lubricating oil composition contains such sulfonate. However, there is no problem that the total amount of alkaline earth metal of this alkaline earth metal sulfonate and Component (B) is within the range of Component (B) as described above.

(5) Other Additives

The lubricating oil composition of the present invention may be blended with known additives for the purpose of further enhancing its functions as a lubricating oil. Examples of such additives are (D) boron-free ashless dispersants, (E) friction modifiers, (F) oxidation inhibitors, (G) extreme pressure additives, (H) wear inhibitors, (I) viscosity index improvers, (J) rust preventives, (K) corrosion inhibitors, (L) pour-point depressants, (M) rubber swelling agents, (N) antifoamers, and (O) coloring agents. These additives may be used singlely or in combination.

(D) Boron-free Ashless Dispersants

Specific examples of boron-free ashless dispersants which may be blended with a lubricating oil composition of the present invention are ashless dispersants prior to the modification with a boron compound as described with respect to Component (A). In the present invention, one or more kinds of compounds selected from such ashless dispersants may be blended in an arbitrary amount. The content of boron-free ashless dispersants is preferably from 0.1 to 10 percent by mass, based on the total mass of the lubricating oil composition.

(E) Friction Modifiers

Friction modifiers which may be used in combination with the lubricating oil composition of the present invention are any conventional compounds which have been used as friction modifiers for lubricating oils and include amine compounds, fatty acid esters, fatty acid amides, and fatty acid metal salts, each of which has at least one alkyl or alkenyl group having 6 to 30 carbon atoms, preferably straight-chain alkyl or alkenyl group having 6 to 30 carbon atoms per molecule.

Examples of the amine compounds include straight-chain or branched, preferably straight-chain aliphatic monoamines having 6 to 30 carbon atoms, straight-chain or branched, preferably straight-chain aliphatic polyamines having 6 to 30 carbon atoms, and alkyleneoxide adducts of these aliphatic amines. Examples of the fatty acid esters include esters of straight-chain or branched, preferably straight-chain fatty acids having 7 to 31 carbon atoms and aliphatic monohydric alcohols or aliphatic polyhydric alcohols. Examples of the fatty acid amides include amides of straight-chain or branched, preferably straight-chain fatty acids having 7 to 31 carbon atoms and aliphatic monoamines or aliphatic polyamines. Examples of the fatty acid metal salts include alkaline earth metal salts (magnesium salts and calcium salts) or zinc salts of straight-chain or branched, preferably straight-chain fatty acids having 7 to 31 carbon atoms.

In the present invention, any one or more kinds of compounds selected from such friction modifiers may be blended in an arbitrary amount. The content of the friction modifiers is from 0.01 to 5.0 percent by mass, preferably from 0.03 to 3.0 percent by mass, based on the total mass of the lubricating oil composition.

(F) Oxidation Inhibitors

Oxidation inhibitors which may be used in combination with the lubricating oil compositions of the present invention may be any conventional ones such as phenol-based compounds or amine-based compounds which are usually used as oxidation inhibitors in a lubricating oil.

Specific examples of the oxidation inhibitors are alkylphenols such as 2-6-di-tert-butyl-4-methylphenol, bisphenols such as methylene-4,4-bisphenol(2,6-di-tert-butyl-4-methylphenol), naphtylamines such as phenyl-α-naphtylamine, dialkyldiphenylamines, zinc dialkyldithiophosphates such as zinc di-2-ethylhexyldithiophosphate, and esters of (3,5-di-tert-butyl-4-hydroxyphenyl) fatty acid such as propionic acid and monohydric or polyhydric alcohols such as methanol, octadecanol, 1,6-hexanediol, neopentyl glycol, thiodiethylene glycol, triethylene glycol, and pentaerythritol.

Any one or more compounds selected from the above-described oxidation inhibitors may be blended in an arbitrary amount. The content of the oxidation inhibitors is generally from 0.01 to 5.0 percent by mass, based on the total mass of the lubricating oil composition.

(G) Extreme Pressure Additives

Extreme pressure additives which may be used in combination with the lubricating oil compositions of the present invention may be any compounds which have been conventionally used as extreme pressure additives in lubricating oils. Examples of the extreme pressure additives include sulfur-based compounds such as disulfides, olefin sulfides, and sulfide oils and fats. Any one or more compounds selected from these extreme pressure additives may be blended in an arbitrary amount. The content of the extreme pressure additives is generally from 0.01 to 5.0 percent by mass, based on the total mass of the lubricating oil composition.

(H) Wear Inhibitors

Examples of wear inhibitors which may be used in combination with the lubricating oil compositions of the present invention include zinc dialkyldithiophosphates, phosphoric acid, monophosphates, diphosphates, triphosphates, metal salts or amine salts of phosphoric acid, monophosphates, and diphosphates, and mixtures thereof.

Among these wear inhibitors, those other than phosphoric acid are generally compounds containing a hydrocarbon group having 2 to 30, preferably 3 to 20 carbon atoms.

The content of the wear inhibitors is preferably from 0.005 to 0.2 percent by mass in terms of phosphorus, based on the total mass of the lubricating oil composition. A content of less than 0.005 percent by mass in terms of phosphorus would be less effective in wear resistance, while a content of more than 0.2 percent by mass would deteriorate the oxidation stability of the resulting lubricating oil composition.

(I) Viscosity Index Improvers

Viscosity index improvers which may be used in combination with the lubricating oil compositions of the present invention may be non dispersion-type viscosity index improvers such as polymers or copolymers of one or more monomers selected from various methacrylates or hydrogenated products thereof and dispersion-type viscosity index improvers such as copolymers of methacrylates and various methacrylates further containing nitrogen compounds.

Another examples of viscosity index improvers are non dispersion- or dispersion-type ethylene-α-olefin copolymers wherein the α-olefin may be propylene, 1-butene, or 1-pentene, or the hydrides thereof, polyisobutylenes or the hydrides thereof, styrene-diene hydrogenated copolymers, styrene-maleate anhydride copolymers, and polyalkylstyrenes.

It is necessary to select the molecular weight of these viscosity index improvers considering the shear stability thereof. Specifically, the number-average molecular weight of non-dispersion or dispersion type polymethacrylates is preferably from 5,000 to 150,000, and more preferably from 5,000 to 35,000. The number-average molecular weight of polyisobutylenes or hydrides thereof is from 800 to 5,000, preferably from 1,000 to 4,000. Ethylene-α-olefin copolymers and hydrides thereof each have a number-average molecular weight of from 800 to 150,000, preferably from 3,000 to 12,000.

Among these viscosity index improvers, the use of ethylene-α-olefin copolymers or hydrides thereof is contributive to the production of a lubricating oil composition which is excellent in particularly shear stability.

Any one or more compounds selected from the above-described viscosity index improvers may be blended in an arbitrary amount. The content of the viscosity index improvers is generally from 0.1 to 40.0 percent by mass, based on the total mass of the lubricating oil composition.

(J) Rust Preventives

Examples of rust preventives include alkenyl succinic acids, alkenyl succinic acid esters, polyhydric alcohol esters, petroleum sulfonates, and dinonylnaphthalenesulfonate.

(K) Corrosion Inhibitors

Corrosion inhibitors which may be used in combination with the lubricating oil composition of the present invention may be any compounds which have been usually used as corrosion inhibitors for lubricating oils. Examples of the corrosion inhibitors include benzotriazole-, tolyltriazole-, thidiazole-, and imidazole-based compounds.

(L) Pour-point Depresants

Examples of pour-point depressants are polymethacrylate-based polymers, which are adaptable to a lubricating base oil to be used.

(M) Rubber Swelling Agents

Examples of rubber swelling agents include aromatic compounds and sulfur-based compounds.

(N) Antifoamers

Examples of antifoamers are silicones such as dimethylsilicone and fluorosilicone.

In the present invention, the contents of these additives may be arbitrarily selected. However, in general, the content of each of the rust preventives, corrosion inhibitors, pour-point depressants, and rubber swelling agents is from 0.005 to 3 percent by mass, based on the total mass of the composition. The content of the antifoamers is from 0.0005 to 0.01 percent by mass, based on the total mass of the composition.

(6) Viscosity of Final Product

The lubricating oil compositions of the present invention have a kinematic viscosity at 100° C. of preferably 4 to 30 $mm^2/s$, more preferably 5 to 25 $mm^2/s$.

The lubricating oil compositions of the present invention are excellent in anti-wear properties and anti-pitching properties and thus are suitably applicable as lubricating oils which are required to have such properties, such as gear oils for automobiles, construction machinery, and agriculture machinery, and lubricating oils for automatic or manual transmissions. Alternatively, the lubricating oil compositions of the present invention are also applicable as gear oils for industrial use, lubricating oils for gasoline engines, diesel engines, and gas engines of automobiles such as two or four wheel vehicles, electric generators, and vessels; turbine oils; and compressor oils.

BEST MODE FOR CARRYING OUT THE INVENTION

The present invention will be further described in more detail with reference to the following examples and comparative examples but are not limited thereto.

EXAMPLES 1 TO 7 AND COMPARATIVE EXAMPLES 1 TO 7

Various lubricating oil compositions (Examples in Table 1 and Comparative Examples in Table 2) were prepared by adding various additives shown in Table 1 or 2 to a base oil (mineral oil having a kinematic viscosity at 100° C. of 3.8 $mm^2/s$). The amount of each additives was on the basis of total mass of the composition.

Each of the various lubricating oil compositions was evaluated by (1) wear inhibition test and (2) fatigue life test. The results of these evaluation tests are also shown in each table. For the comparison, commercially available lubricating oil compositions (Comparative Examples 5 to 7 in Table 2) were evaluated by the same test. The results are also shown in Table 2.

(1) Anti-wear Property Test

The anti-wear properties of each composition was evaluated using an IAE gear oil tester in the manner described below. The weight of the gear before and after the wear test was measured. The decrease of the weight was evaluated as the criterion.

(Run-in Conditions)

| | |
|---|---|
| Oil temperature: | 80° C. |
| Number of revolutions: | 2,500 rpm |
| Load: | 380 N |
| Test time: | 20 minutes |

(Actual Test Conditions)

| | |
|---|---|
| Oil temperature: | 80° C. |
| Number of revolutions: | 3,000 rpm |
| Load: | 380 N |
| Test time: 1 | 20 minutes |

(Evaluation Criterion)

When a commercially available automatic transmission oil is used, the amount of wear is in the range of 0 to 100 mg. Therefore, if the amount of wear is 100 mg or less, the composition was evaluated as being excellent in anti-wear properties.

(2) Fatigue Life Test

The fatigue life of each of the compositions was evaluated using a two cylinder-type fatigue tester in the following manner.

(Cylinder)

| | |
|---|---|
| Material: | SCM436 |
| Shape: | Φ 68 mm × 10 mm |
| Hardness: | SB3000 to 340 |

(Test Conditions)

| | |
|---|---|
| Peripheral velocity: | driving side: 12 m/s, Driven side: 10 m/s |
| Oil temperature: | 60° C. |
| Surface pressure: | 12 MPa |

(Evaluation Criterion)

Time consumed until surface damages such as pitching appear was evaluated as fatigue life. If the fatigue life of the composition is 50 hours or longer, the composition was evaluated as having a long fatigue life.

As apparent from the results shown in Table 1, the lubricating oil compositions of the present invention (Examples 1 to 7) had excellent properties such as excellent anti-wear properties and a long fatigue life.

Whereas, as apparent from the results shown in Table 2, the compositions of Comparative Examples 1 and 4 whose content of Component (A) or (C) was less than that as defined by the present invention were poor in anti-wear properties. The compositions of comparative Examples 2 and 3 whose content of Component (B) was less than that as defined by the present invention had a short fatigue life due to pitching.

Most common commercially available gear oils (SP-based gear oils) of Comparative Examples 5 and 6 and a common commercially available automatic transmission oil of Comparative Example 7 had a short fatigue life.

TABLE 1

| | | Examples | | | | | | |
|---|---|---|---|---|---|---|---|---|
| | | 1 | 2 | 3 | 4 | 5 | 6 | 7 |
| Base oil | | Mineral oil | Mineral oil | Mineral oil | Mineral oil | Mineral oil | Mineral oil | Mineral oil |
| Additives | | | | | | | | |
| (A) Boron-containing ashless dispersant | mass % [in terms of B] | | | | | | | |
| Boric add-modified succinimide | | 0.05 | 0.05 | 0.05 | 0.05 | 0.05 | 0.05 | 0.07 |
| (B) Alkaline earth metal detergent | mass % [in terms of Ca | | | | | | | |
| Calcium sulfonate (300BN) | | 0.14 | 0.14 | 0.14 | 0.24 | | | 0.14 |
| Calcium sulfonate (10BN) | | | | | | 0.07 | 0.12 | |
| (C) Alkali metal borate | mass % [in terms of B] | | | | | | | |
| Potassium borate hydrate | | 0.007 | 0.02 | 0.04 | 0.02 | 0.02 | 0.02 | 0.02 |
| Other Additives (*1) | mass % | 15.0 | 15.0 | 15.0 | 15.0 | 15.0 | 15.0 | 15.0 |
| Test results | | | | | | | | |
| Anti-wear property (IAE gear test) | | | | | | | | |
| Weight loss by wear | mg | 42 | 16 | 9 | 11 | 40 | 37 | 8 |

TABLE 1-continued

| | | Examples | | | | | | |
|---|---|---|---|---|---|---|---|---|
| | | 1 | 2 | 3 | 4 | 5 | 6 | 7 |
| Fatigue life (Two cyclinder-type tester) | | | | | | | | |
| Fatigue life | h | 102 | 77 | >120 | >120 | 93 | 113 | 58 |

(*1) (D) Boron-free succinimide ashless dispersant
(E) Amine- and ester-based friction modifiers
(F) Amine- and phenol-based oxidation inhibitors
(H) Phosphorus-based wear inhibitor
(I) Polymethacrylate viscosity index improver
(J) Polymethacrylate-based pour-point depresant

TABLE 2

| | | Comparative Examples | | | | | | |
|---|---|---|---|---|---|---|---|---|
| | | 1 | 2 | 3 | 4 | 5 | 6 | 7 |
| Base oil | | Mineral oil | Mineral oil | Mineral oil | Mineral oil | commercially available SP-based gear oil AP I GL-5 | commercially available SP-based gear oil AP I GL-3 | commercially available ATF Dexron III type |
| Additives | | | | | | | | |
| (A) Boron-containing ashless dispersant | mass % [in terms of B] | | | | | | | |
| Boric add-modified succinimide | | 0.002 | 0.05 | 0.05 | 0.05 | | | |
| (B) Alkaline earth metal detergent | mass % [in terms of Ca | | | | | | | |
| Calcium sulfonate (300BN) | | 0.14 | 0.005 | | 0.14 | | | |
| Calcium sulfonate (10BN) | | | | 0.005 | | | | |
| (C) Alkali metal borate | mass % [in terms of B] | | | | | | | |
| Potassium borate hydrate | | 0.04 | 0.04 | 0.04 | — | | | |
| Other Additives (*1) | mass % | 15.0 | 15.0 | 15.0 | 15.0 | | | |
| Test results | | | | | | | | |
| Anti-wear property (IAE gear test) | | | | | | | | |
| Weight loss by wear | mg | 116 | 16 | 26 | 132 | 3 | 5 | 22 |
| Fatigue life (Two cyclinder-type tester) | | | | | | | | |
| Fatigue life | h | 102 | 26 | 31 | 84 | 6 | 19 | 29 |

(*1) (D) Boron-free succinimide ashless dispersant
(E) Amine- and ester-based friction modifiers
(F) Amine- and phenol-based oxidation inhibitors
(H) Phosphorus-based wear inhibitor
(I) Polymethacrylate viscosity index improver
(J) Polymethacrylate-based pour-point depresant

APPLICABILITY IN THE INDUSTRIES

As described above, the lubricating oil compositions of the present invention are excellent in anti-wear properties and can be extended in fatigue life by inhibiting pitching or flaking. Therefore, the lubricating oil compositions are suitably applicable as lubricating oils which are required to have such properties, such as gear oils for automobiles, construction machinery, and agriculture machinery, and lubricating oils for automatic or manual transmissions. Alternatively, the lubricating oil compositions of the present invention are also applicable as gear oils for industrial use, lubricating oils for gasoline engines, diesel engines, and gas engines of automobiles such as two or four wheel vehicles, electric generators, and vessels; turbine oils; and compressor oils.

The invention claimed is:

1. A lubricating oil composition which comprises a lubricating base oil having a kinematic viscosity of 1 to 10 $mm^2/s$ at 100° C., (A) a boron-containing ashless dispersant in an amount of 0.02 to 0.1 percent by mass in terms of boron, based on the total mass of the composition, (B) an alkaline earth metal-based detergent with a base number of 0 to 500 mgKOH/g in an amount of 0.01 percent by mass or more in terms of alkaline earth metal, based on the total mass of the composition, and (C) an alkali metal borate or a hydrate thereof in an amount of 0.002 to 0.06 percent by mass in terms of boron, based on the total mass of the composition.

2. The lubricating oil composition according to claim 1 wherein Component (C) is a potassium borate hydrate.

3. The lubricating oil composition according to claim 1 wherein Component (A) is a succinimide modified with a boron compound.

4. The lubricating oil composition according to claim 1 wherein Component (B) is an alkaline earth metal sulfonate or an alkaline earth metal salicylate.

5. The lubricating oil composition according to claim 1 wherein Component (B) is an alkaline earth calcium.

6. The lubricating oil composition according to claim 1 wherein said composition is used in an automatic transmission equipped with a wet clutch.

* * * * *